United States Patent [19]

Tomosada et al.

[11] 4,372,673

[45] Feb. 8, 1983

[54] IMAGE FORMING APPARATUS

[75] Inventors: Masahiro Tomosada; Yoshimasa Kimura, both of Kawasaki; Hisashi Sakamaki, Yokohama, all of Japan

[73] Assignee: Canon Kabushiki Kaisha, Tokyo, Japan

[21] Appl. No.: 242,721

[22] Filed: Mar. 12, 1981

Related U.S. Application Data

[62] Division of Ser. No. 42,235, May 24, 1979, Pat. No. 4,264,188.

[30] Foreign Application Priority Data

| | | | |
|---|---|---|---|
| May 31, 1978 | [JP] | Japan | 53-65924 |
| May 31, 1978 | [JP] | Japan | 53-65925 |
| May 31, 1978 | [JP] | Japan | 53-65926 |
| May 31, 1978 | [JP] | Japan | 53-65927 |
| May 31, 1978 | [JP] | Japan | 53-65928 |

[51] Int. Cl.[3] ..... G03G 15/00

[52] U.S. Cl. ..... 355/14 R; 355/8; 355/14 SH

[58] Field of Search ..... 355/14 SH, 3 SH, 8, 355/14 R

[56] References Cited

U.S. PATENT DOCUMENTS

| | | | |
|---|---|---|---|
| 4,009,957 | 3/1977 | Suzuki et al. | 355/8 X |
| 4,026,647 | 5/1977 | Kanno et al. | 355/8 |
| 4,175,850 | 11/1979 | Bujese | 355/14 R |

*Primary Examiner*—Richard L. Moses

*Attorney, Agent, or Firm*—Fitzpatrick, Cella, Harper & Scinto

[57] ABSTRACT

A copy machine has an original feeder for feeding an original document to a predetermined position, image forming apparatus including an original scanning unit, for forming an image of a positioned original onto a copy sheet, a copy feeder for feeding a copy sheet after the start of the feed of the original but before scanning is begun, a jam detector for detecting jamming of a fed original document, and control circuitry for controlling the image forming apparatus in accordance with the output of the jam detector.

4 Claims, 25 Drawing Figures

IMAGE FORMING APPARATUS

This is a division of application Ser. No. 042,235, filed May 24, 1979, now U.S. Pat. No. 4,264,188.

BACKGROUND OF THE INVENTION

1. Field of the Invention

The present invention relates to an image forming apparatus such as a copier.

2. Description of the Prior Art

In the field of copiers there are already known those designed for simple real-size black-and-white copying, those capable of color copying, those capable of copying with modified image magnification, and those capable of copying with automatic successive feeding of originals. In general, however, such copiers are excessively large-sized and complicated to be acceptable to the ordinary users. Besides such copiers require complicated operations and are associated with a slow copying speed. Particularly those designed for making multiple copies from each of successively fed originals are associated with a complicated structure and a very low copying speed, and are therefore not suitable for achieving high-speed copying though they serve manpower saving. Also such copiers may result in jamming or originals under feeding, thus often leading to damage of valuable originals.

Besides in apparatus utilizing sheet detection by optical reflection for the purpose of jamming detection, it is difficult to achieve a satisfactory detection sensitivity, since the sheet to be detected can be rarely brought to the position of the maximum sensitivity of the detecting device. Such detecting device tends to cause detection errors particularly for the sheets transported in a slightly curved state, thus increasing the jamming and leading to fatal troubles such as original breakage.

SUMMARY OF THE INVENTION

The object of the present invention is to provide a copier provided with a simple and easily operable automatic original feeding mechanism not associated with the above-mentioned drawbacks.

Another object of the present invention is to provide a copier with a substantially increased copying speed.

Still another object of the present invention is to simplify the operation of the copier designed for multiple modes such as copying with modified magnification and color copying, thus reducing the erred copyings.

Still another object of the present invention is to provide an improvement on the copier provided with the function of automatic original changing.

Still another object of the present invention is to provide an apparatus capable of detecting accurately and with precision the jamming of originals or transfer sheets.

Still another object of the present invention is to provide an automatic setting of the copier at a particular copying mode such as with a specified image magnification by mounting an attachment such as an automatic original feeding device to said copier.

Still another object of the present invention is to provide an improvement in the copier wherein the power supply to said attachment is separate from that to the copier.

Still another object of the present invention is to provide a copier allowing rapid change from an ordinary copying mode of a bound original to a continuous copying mode by automatic feeding of sheet originals and provided with increased safety and improved performance accuracy.

Still another object of the present invention is to provide a copier capable of rapidly detecting the jamming thereby preventing ensuing troubles, and still not requiring a special timing circuit for jam detection thereby enabling a simplified structure and an improved functional accuracy.

BRIEF DESCRIPTION OF THE DRAWINGS

FIG. 1-2 is a perspective view of said copier shown in FIG. 1-1;

FIGS. 2-1 and 2-2 are plan views of operating panels of the copier shown in FIG. 1;

FIGS. 9-1 to 9-3 are views of other examples of the control circuit;

FIGS. 10-1 to 10-3 are function time charts of the circuits shown in FIGS. 9-1 to 9-3;

DESCRIPTION OF THE PREFERRED EMBODIMENTS

The present invention will now be clarified in detail by the following explanation on the preferred embodiments thereof taken in conjunction with the attached drawings.

Figure 1:
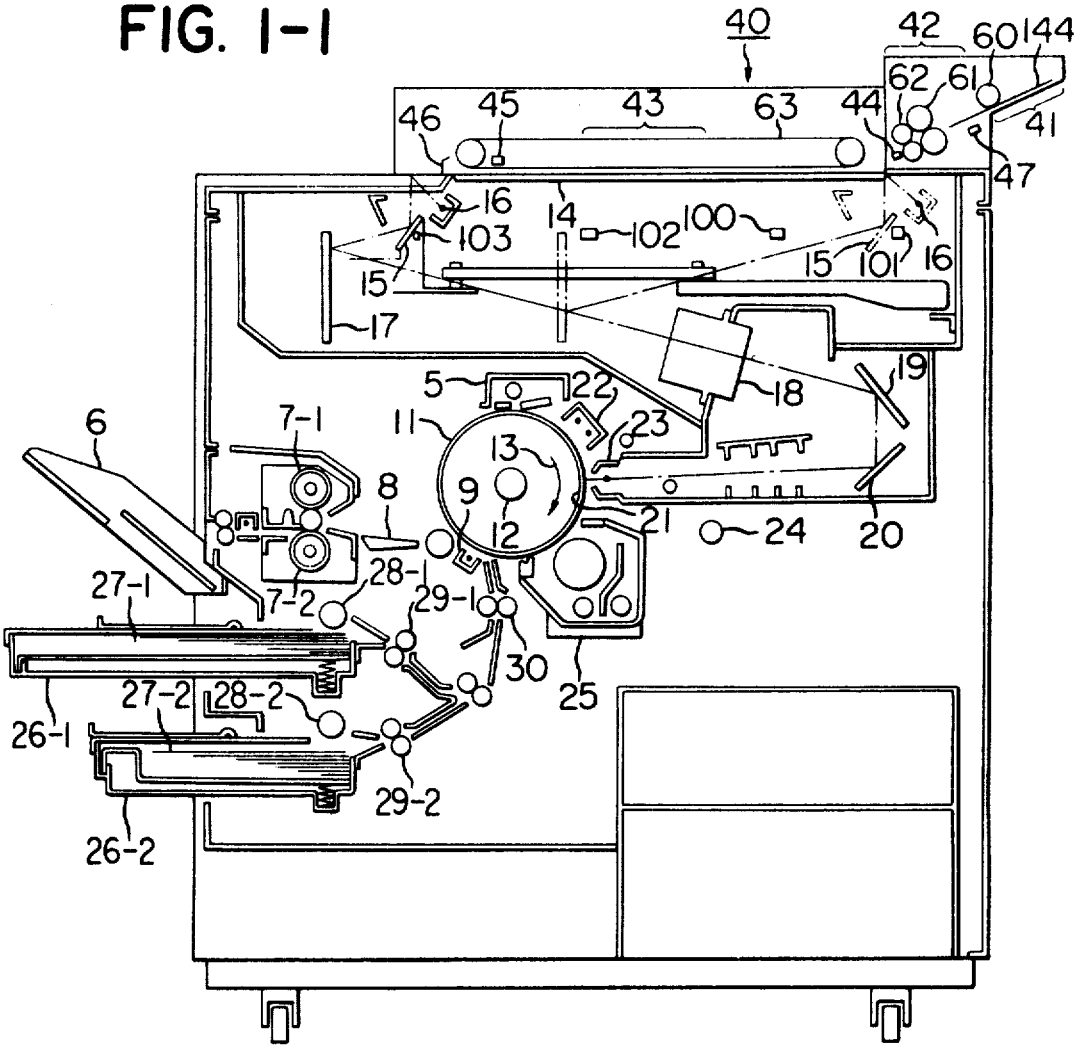
FIG. 1-1 is a cross-sectional view of a copier embodying the present invention.
Figures 1, 2:
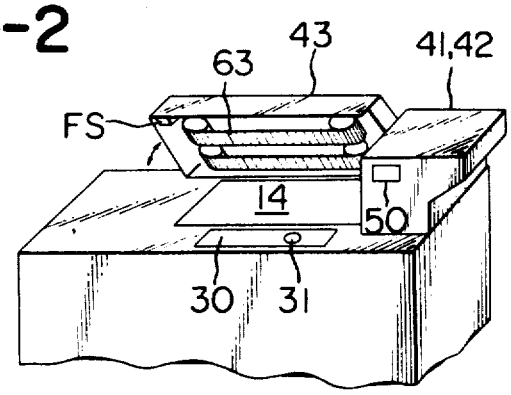
Figures 1, 2:
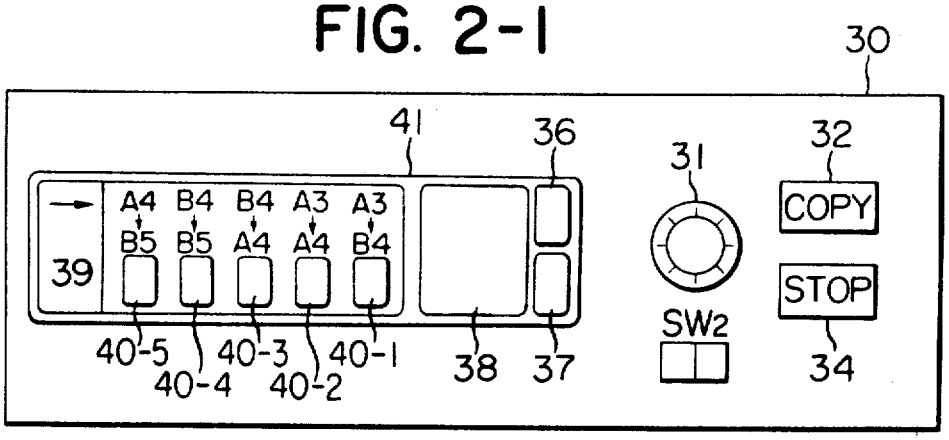
Figure 2:
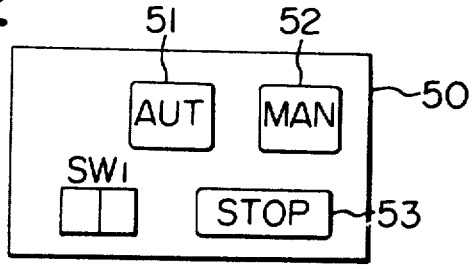

FIG. 1-1 is a cross-sectional view of a copier of variable magnification provided with an automatic original feeding device wherein the present invention is applicable, while FIG. 1-2 is a perspective view of said copier wherein said automatic original feeding device is turned up. FIG. 2-1 is a plan view of the operating panel of the copier shown in FIG. 1-1, and FIG. 2-2 is a plan view of the operating panel of said automatic original feeding device.

A drum 11 of which external periphery is composed of a three-layered photosensitive member utilizing CdS photoconductive material is rotatably supported on a shaft 12 and initiates rotation in the direction of arrow 13 in response to a copy start instruction.

When the drum 11 rotates to a determined position, an original placed on an original supporting glass plate 14 is illuminated by an illuminating lamp 16 structured integrally with a first scanning mirror 15, and the light reflected by said original is scanned by means of said first scanning mirror 15 and a second scanning mirror 17. In said scanning said first and second scanning mirrors 15, 17 are displaced with a relative speed ratio of 1:½ to maintain a constant optical path length in front of a lens 18.

The beam thus reflected is transmitted said lens 18, a third mirror 19 and a fourth mirror 20 and is foxed in an exposure station 21 onto said drum 11.

Separately said drum 11 is subjected to an electrostatic charging (for example positive charging) by means of a primary charger 22 and thereafter subjected to the slit exposure in said exposure station 21 of the image focused in the above-explained manner.

Simultaneously with said exposure said drum is subjected to a charge elimination by an AC discharge or a DC discharge of a polarity opposite to that of said primary charging from a charge eliminator 23, and further subjected to a flush exposure by a flush exposure lamp 24 thereby forming an electrostatic latent image of an elevated contrast on the surface of said drum 11. Said latent image is successively rendered visible as a toner image in a developing station 25.

A transfer sheet 27-1 or 27-2 contained in a cassette 26-1 or 26-2 is supplied into the apparatus by a feed roller 28-1 or 28-2 and transported toward the drum 11 in such a manner that the leading end of said sheet coincides with the leading end of said toner image formed on said drum through a first register roller 29-1 or 29-2 for achieving approximate timing of sheet supply and a second register roller 30 for achieving exact timing of sheet supply.

Successively the toner image on said drum 11 is transferred onto said transfer sheet 27 while it passes through a gap between said drum 11 and a transfer charger 9.

Upon completion of the image transfer, the transfer sheet is guided to a conveyor belt 8 and further to a pair of fixing rollers 7-1, 7-2 wherein said transferred image is fixed by pressure and heating, and the transfer sheet having thus fixed image is thereafter ejected onto a tray 6.

On the other hand the surface of the drum 11 after the image transfer is cleaned in a cleaning station 5 comprising an elastic blade to be prepared for the succeeding image forming cycle.

The copier shown in FIG. 1-1 is capable of forming, on the drum 11, a size-reduced image of the information of the original placed on said original supporting glass plate 14, and such size reduction can be achieved by changing the position of the lens 18 corresponding to the desired amount of reduction and modifying the speeds of said first scanning mirror 15 and illuminating lamp 16 and of the second scanning mirror 17 in response to said amount of reduction. Such method of size reduction is however already known in the art and shall therefore not be explained in detail.

There is also shown an automatic original feeding device 40, in which 41 is a sheet bucket for storing the originals, 42 is a feeder for separating and feeding said originals, 43 is a setter for placing the original on the glass plate 14, and 48 is a tray for containing the originals after use. Structurally said feeding device 40 is made detachable from the copier wherein said setter 43 can be opened as shown in FIG. 1-2 independently from said sheet bucket 41 and the feeder 42.

FIG. 2-1 shows the detail of an operating panel of the copier of FIG. 1-1, wherein there are shown a copy number setting dial 31, a copy button 32 for initiating the copying of a number selected by said dial 31, a stop button 34 for instructing the interruption of copying operation, a button 36 for instructing the supply of transfer sheet from the upper cassette 26-1 shown in FIG. 1-1, a button 37 for instructing the supply of transfer sheet from the lower cassette 26-2 shown in FIG. 1-2, and a display unit 38 for displaying the sheet size selected by said button 36 or 37, said size being detected by a combination of a cam provided on said cassette and a microswitch provided on the copier.

In a part of said operating panel there is provided a recessed portion 41 constituting a size reduction operating unit and accomodating buttons 40-1—40-5 for selecting desired size reduction, said recessed portion 41 being further provided with a slidable lid 39 for covering said recessed portion. Among said buttons, the button 40-2 for example instructs a ½ size reduction copying to make an A-4 sized copy from an original of A-3 size and simultaneously causes to select the paper feed roller for the cassette containing the transfer sheets of A-4 size. Said cover 39 is slidable in the direction of arrow to cover said buttons 40-1–40-5 thereby prohibiting the manipulation thereof or is opened as illustrated to expose said buttons thereby allowing manipulation thereof.

FIG. 2-2 is a plan view of the operating panel for the automatic original feeding device 40 provided on a flat portion thereof, wherein there are shown a power switch SW1, a button 51 for feeding the originals contained in the bucket in succession for copying, another button 52 for manual setting of an original for copying, and still another button 53 for interrupting the automatic feeding.

In the following there will be briefly explained the function of the automatic original feeding device 40 shown in FIGS. 1-1 and 1-2.

At first the originals to be copied are placed in the bucket, and the power is supplied both to the copier and to the automatic original feeding device. Upon actuating the automatic feed button 51 of the control panel 50 of said automatic original feeding device 40 and also the copy start button 32 of the control panel 30 of the copier, a feeder roller 60 of said device advances the originals toward a separating roller 61 which separates and advances the lowermost original to a register roller 62. Said register roller 62, which is normally in stopped state, is driven at a predetermined timing for a period required for advancing one original, thereby feeding said original to a belt 63 maintained in circulation above the original supporting glass plate 14. The original thus supported by friction of the belt 63 is advanced until it reaches a claw 46 previously lowered at a predetermined timing and is stopped at this position. The belt 63 is thereafter maintained still in circulation for a short period until it is stopped at a determined timing, and during said period the belt 63 glides over the original whereby the eventually diagonal position of the original can be corrected. Successively the forward displacement of the lamp 16 and mirrors 15, 17 of the copier is initiated to perform the scanning thereby obtaining a copied image on a transfer sheet in the afore-mentioned manner. Upon completion of the copying of a number selected by the dial 31, an end signal is supplied to the automatic original feeding device 40 to elevate the claw 46 and to restart the circulation of the belt 63 thereby ejecting the original from the glass plate 14. Simultaneously with said ejecting operation, the rollers 60, 61 and 62 are started to feed the succeeding original to the belt 63, thereby minimizing the time required until the start of copying of the succeeding original. The continuous copying can be thus achieved by exchanging the originals in succession in this manner.

The automatic original feeding device 40 is provided with detectors 44, 45 for detecting the presence of an original, said detector 44 being for detecting original jamming at the separating roller 61 and the register roller 62, while the detector 45 being provided for detecting the jamming or missed ejection at the setter portion of the belt 63. Each of said detectors 44, 45 is of a light reflection type composed of a photoreceptor combined with plural light-emitting diodes. Besides the belt 63 is grounded to the main frame in order to eliminate the electrostatic charge accumulated by the friction with the original.

The automatic original or document feeding device 40 is hinged on the copier in such a manner that it is rotatable from the front to the back of copier so as to be liftable from the glass plate 14 as shown in FIGS. 1-2. On said device there is provided a switch FS for interrupting the power supply to the automatic document feeder automatically when it is lifted in the above-mentioned manner, thereby preventing erroneous function thereof and assuring safety even when the power switch SW1 or the copy start button is operated by mistake.

Figure 3:
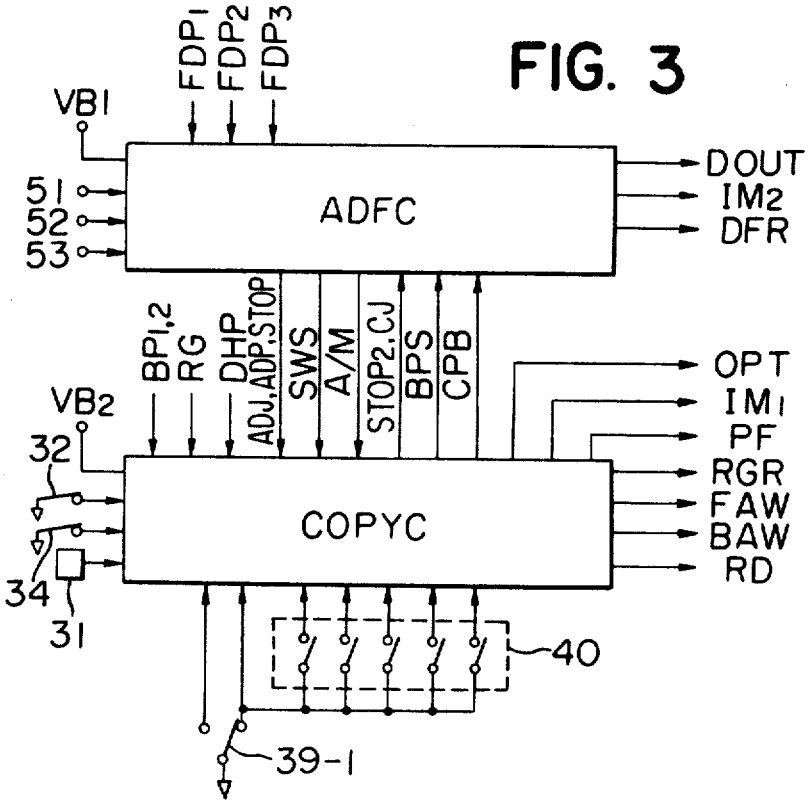
FIG. 3 is a block diagram of the control unit of the copier shown in FIG. 1.

FIG. 3 is a block diagram of the control circuit of the apparatus shown in FIG. 1, wherein there are shown a sequence operation control unit ADFC for said automatic document feeder 40; a control unit COPYC for sequence operation and magnification selection in the copier shown in FIG. 1; power switches SW1 and SW2 corresponding to those shown in FIGS. 2-1 and 2-2; automatic feeding, manual feeding and stop buttons 51-53 corresponding to those shown in FIG. 2-2; copy number dial 31, copy start button 32, stop button 34 and switches 40 for magnification changes corresponding to those shown in FIG. 2-1; and a magnification change instructing switch 39-1 to be connected to the terminal at right or at left respectively when the cover 39 shown in FIG. 2-1 is opened or closed.

Said control unit ADFC releases various output signals, among which DOUT is for activating a plunger for lifting the claw 46, IM2 for starting a motor for driving the belt 63, and DFR is for connecting a clutch of a belt motor for driving the rollers 60, 61 and 62. Also among the output signals from the copy control unit COPYC, OPT is for activating chargers 22, 23 and 29 in synchronization with another output signal IM1 for starting a motor M1 for driving the drum 11, PF is for starting the paper feed rollers 28-1, 29-1, 28-2 and 29-2, RGR is for starting the register roller 30, FAD is for lighting the lamp 16 and initiating the forward advancement of the optical system composed of the lamp 16 and mirror 15 and 17, and BAD is for starting the backward advancement of said optical system upon completion of the exposure, wherein the above-mentioned loads being respectively provided clutches connectable to said motor M1 by the respective signals. Also an output signal RD is for setting the above-mentioned mirrors at determined positions in response to the actuation of either of the magnification changing switches 40-1–40-5 and modifying the scanning speed of said optical system to a determined value so as to achieve copying with selected image magnification. Also said copy control unit COPYC receives input signals BP1 and BP2 of position detection for stopping and inverting the displacement of the mirror 15, said signals being respectively generated by microswitches 100, 101 (FIG. 1-1) actuable by said mirror and located in positions corresponding to the longitudinal lengths of originals of A-4 and A-3 sizes respectively; and an input signal RG for starting the register roller 30, said signal being generated by a microswitch 102 placed in the displacing path of said mirror 15. Also the control unit ADFC of the automatic document feeder supplies to the control unit COPYC of the copier an automatic document feeder jam signal ADJ to prevent the start of copying operation when an original jamming is detected in the automatic document feeder 40, and a document void signal ADP for terminating the copying operation after the document on the glass plate is copied for a determined number of times when the documents are no longer contained in the bucket 41. The detectors 44, 45 and 47 respectively generate document detection signals FDP1, FDP2 and FDP3. Consequently the signal ADJ is generated in response to the jam detection by the signals FDP1 and FDP2, while the signal ADP is generated in response to the signal FDP3. SWS is a signal generated when the automatic document feeder 40 is placed on the original supporting glass plate 14 and the power switches SW1 and SW2 are closed to select a size reduction rate from A-3 size to A-4 size by the energization of a relay K1 shown in FIG. 5. A/M is a signal generated by the automatic/manual feeding switch not to start, in the manual feeding mode, the feed rollers 60–62 of the automatic document feeder 40 upon completion of copying cycles of a determined number for an original, or to start, in the automatic feeding mode, the feed rollers upon such completion of copying cycles. Among the signals supplied from the control unit COPYC of the copier to the control unit ADFC of the automatic document feeder, CJ is for interrupting the function of said feeder in case of transfer sheet jamming in the copier, and BPS is generated upon detection of the mirror 15 the reversing position thereof after completion of scannings of a number selected by the dial 31 for starting the belt 63 and the rollers 60–62 for the original exchange.

Figure 4:
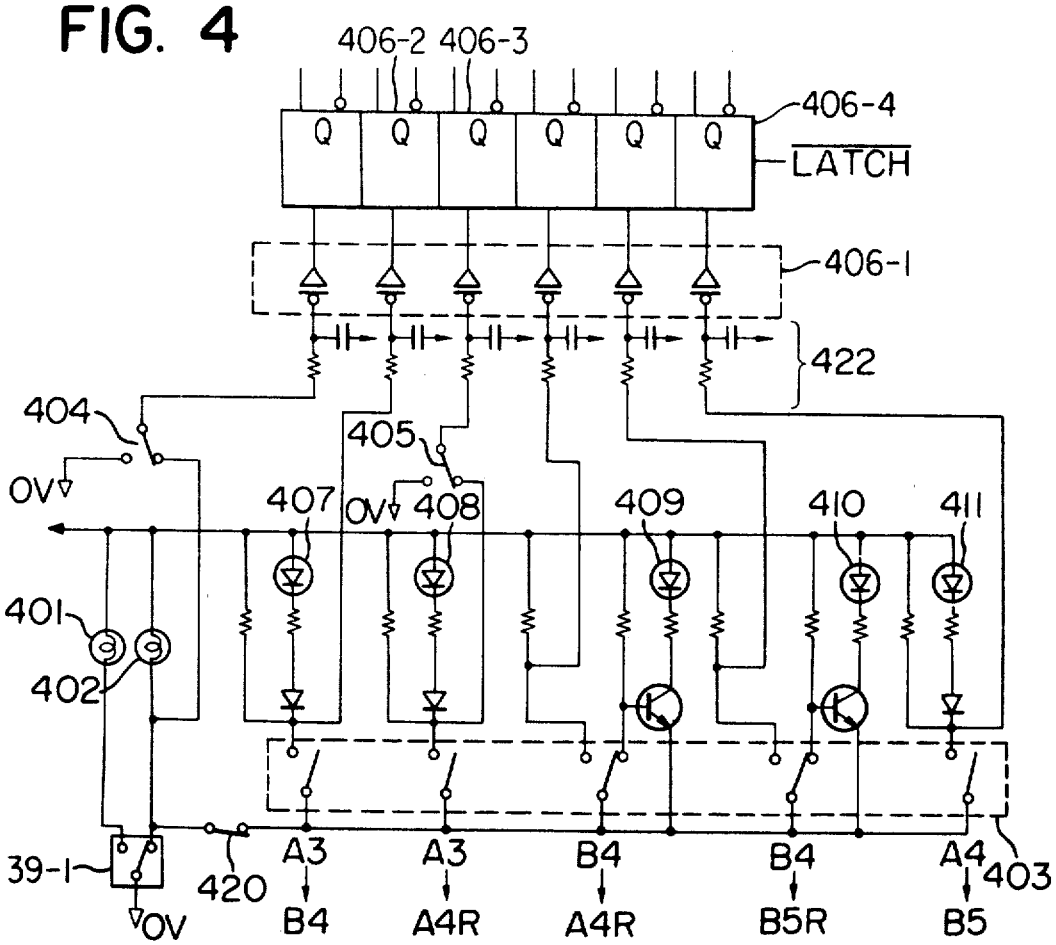
FIGS. 4, 7 and 8 are partial circuit diagrams of the circuit shown in FIG. 3.
Figure 5A:
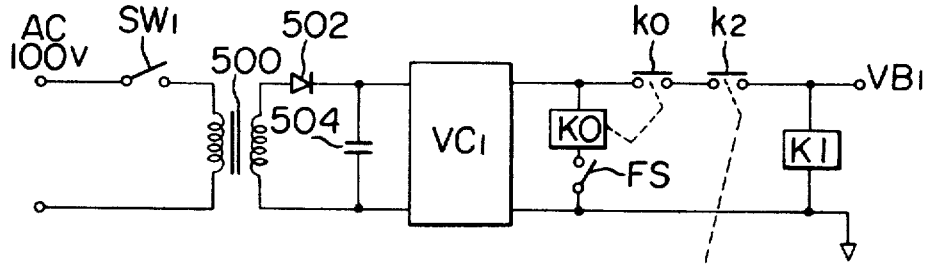
FIG. 5 is a diagram of the power supply circuit for the circuit shown in FIG. 3.
Figure 5B:
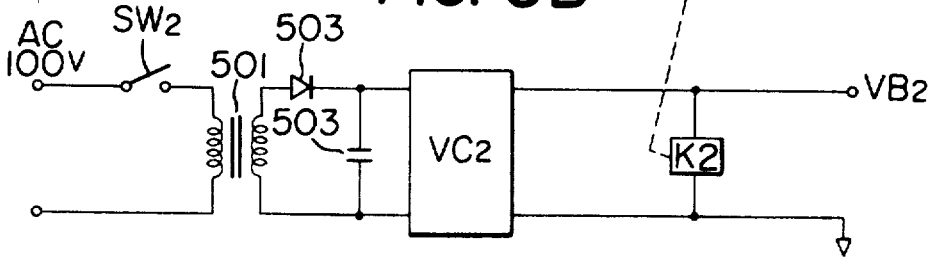

FIGS. 5*a* and 5*b* respectively show power supply circuits for the control units AFDC and COPYC, wherein there are shown voltage-reducing transformers 500, 501, rectifiers 502, 503, smoothing condensers 504, 505, constant voltage circuits VC1, VC2, a switch FS adapted to be actuated by the pressure of the automatic document feeder 40 when it is set on the copier to energize a relay K1, said energization taking place when the power switch SW1 of the automatic document feeder and the power switch SW2 of the copier are both closed to make the contacts 404 and 405 in the state shown in FIG. 4, and a relay K2 which is energized when the switch SW2 is closed whereby the DC voltage VB1 obtained by rectifying and smoothing an AC power supply upon closing the switch SW1 and stabilized by the circuit VC1 is released through a contact R0 of a relay K0 while said voltage VB1 is not supplied when said power switch SW2 of the copier is open, i.e. when the copier is not ready, or when the automatic document feeder is lifted from the glass plate as shown in FIG. 1-2 to open the switch FS thereby prohibiting the function of said automatic document feeder, while the power supply voltage VB2 of the copier is supplied regardless of the state of the switch SW1 or of the position of the automatic document feeder so that the copying operation can be effected when a bound original is placed on the glass plate 14 and the copy start button is actuated.

In the following there will be briefly explained the sequential operations according to the time chart shown in FIG. 6. When the automatic document feeder is set on the glass plate and set to the automatic feeding mode, and in response to the closing of the switches SW1 and SW2 and to the actuation of the copy start button, there are initiated the rotation of the drum motor IM1 and the belt motor and the function of chargers of the copier. Simultaneously the rollers 60, 61 and 62 are rotated for a determined period by the signal DFR to feed an original to the belt, whereupon said belt advances said original in such a manner that it reaches the claw (stopper) until the drum performs a full rotation from the stopped position thereof. After said full rotation the signal FAD is released to initiate the forward advancement of the optical system, said advancement however being initiated after the belt motor IM2 is stopped, in order to prevent the eventual displacement of the original by said belt. The transfer sheet is supplied from the cassette by the feed roller 28-1 after the start of rotation of the drum, but the register roller 30 is start rotation after the belt motor IM2 is stopped. Since the drum cleaning and the sheet feeding are effected before the original is set, it is rendered possible to initiate the exposure immediately after the original setting, thereby substantially increasing the copying speed. Upon arrival of the optical system at the reversing position BP (switch 100 or 101), the signal FAW is replaced by the signal BAW thereby terminating the exposure and initiating the backward displacement of the optical system. Thereafter the second exposure is initiated when the drum reaches the drum hold position DHP. In case the copy number selected by the dial 31 is for example "2", the signal BPS is released upon detection of the reversing position after the second exposure to generate the document ejection signal DOUT to elevate the claw 46 for a determined period by means of the plunger, and to generate the signal IM2 to eject the original by means of the belt. Simultaneously the rollers 60–62 are rotated again by the signal DFR to feed the succeeding original. Thus, as the original ejection is effected by the detection of the last arrival of the optical system at the reversing position, it is rendered possible to exchange the originals simultaneously with the image transfer and drum cleaning, thereby improving the copying efficiency. In case the detector 45 detects the unejected original, i.e. the signal FDP2 is in "1" state at the trailing end of said signal DOUT or namely at the lowering of the claw, the signal ADJ is released to indicate the jammed state on the display device. Also in case the detector 45 does not detect the original by the time the belt is stopped after the original detection by the detector 44, there is displayed the original jamming at the setter 43. Since the signal IM2 is turned off after a short period from the arrival of the original at the correct position, said signal IM2 can be used in cooperation with a jam timer of a certain time delay.

In the foregoing manner two copy cycles are repeated for each original.

The above-explained original feeding is not effected when the automatic document feed is set at the manual mode. Also the original feeding is not effected in the presence of the signal ADJ indicating the jamming in said feeder, the signal CJ indicating the copy sheet jamming, the signal ADP indicating the absence of original in the bucket, or the signal STOP1 or STOP2 respectively indicating the actuation of the stop button on the automatic document feeder or the copier.

Figure 6:
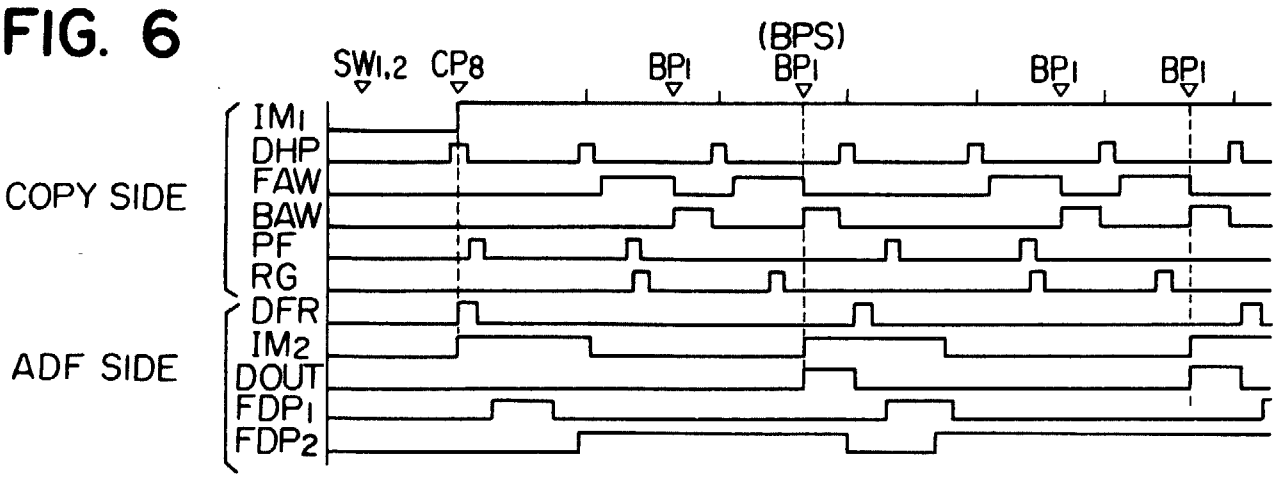
FIG. 6 is a function time chart of the circuit shown in FIG. 3.
Figure 7:
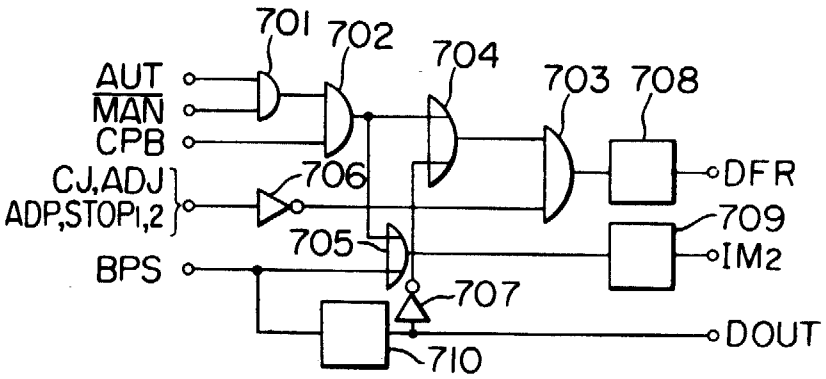

The above-mentioned function can be achieved by a circuit shown in FIG. 7, wherein there are shown AND gates 701–703 for activating feed rollers, OR gates 704, 705, inverters 706, 707 and timers 708–710 for generating, at the leading end of the input signals thereto, the time signals as shown in FIG. 6 for controlling the feed rollers, belt and claw.

Figure 8:
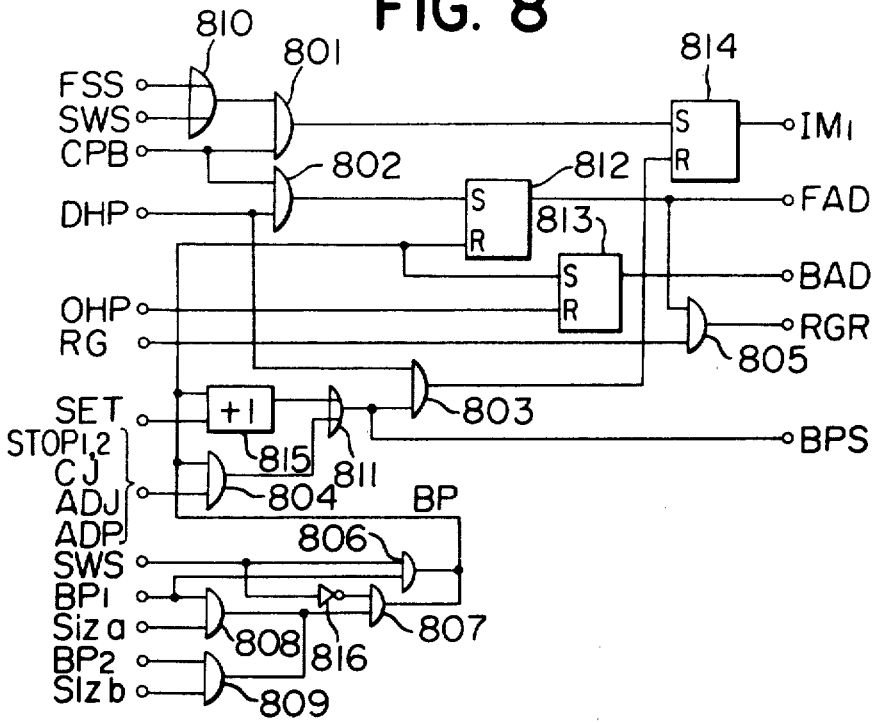

FIG. 8 shows an example of the control circuit for the copier, wherein there are shown AND gates 801–809, OR gates 810, 811, flip-flops 812–814 to be turned on or off at the leading end of the input signal respectively to the port S or R, a counter 815 adapted to store the copy number selected by the dial 31 and to release a signal "1" when the number of arrivals at the reversing point becomes equal to said copy number, and an inverter 816. The signal FSS assumes the "1" state when the switch is open to enable manual copying whenever the setter is lifted. The signal SWS assumes the "1" state when the relay K1 is energized, whereby said relay K1 becomes the condition for the copying operation when the automatic document feeder 40 is set on the glass plate.

The signal OHP is released when the optical system returns to the home position thereof, by means of a microswitch 103 to be actuated by the optical system. The signals SIZa and SIZb are the copy size instructing signals corresponding to the cassette selection by the operating panel 30, wherein the former corresponding to a smaller size selects the signal BP1 generated by a switch 100 provided at a shorter distance on the path of the optical system while the latter corresponding to a larger size selects the signal BP2 in a similar manner, thus determining the scan length. However, when the automatic document feeder is set, the signal SWS assumes the "1" state to force the selection of the shorter scan length and of the cassette for the smaller size.

In case the automatic document feeder is not set on the copier, the drum rotation and the scanning are initiated in response to the signal FSS and the copy start button signal CPB. Upon completion of the scanning of the selected size, the signal BP is released to turn off the signal FAD, to turn on the signal BAD and to step advance the counter 815 from zero. Upon returning of the optical system to the home position, the signal BAD is turned off and the signal FAD is turned on at the determined timing to repeat the copying cycle. When the copying cycle is repeated for a number equal to the preset number of the counter 815, the copying operation is terminated through the gates 811 and 803. In case the entire periphery of the drum is constructed as a seamless photosensitive member, the signal FAD can be turned on immediately upon receipt of the optical system home position signal OHP, thereby enabling continuous copying.

In case the automatic document feeder is set on the copier, the drum rotation is initiated in response to the signals SWS and CPB. The scanning is initiated after the feeding and setting of the original, and the above-explained cycle is repeated after completion of scanning for A-4 size. The size reduction from A-3 size to A-4 size is achieved during the feeding and setting of the original. Also in case the use of a seamless photosensitive member, the scanning can be initiated immediately after the original setting or the stopping of belt drive. Said original setting can be detected by the sensor 45. In this manner the copying speed can be substantially increased in case of the use of a seamless photosensitive member.

In case the signal STOP1, STOP2, CJ, ADJ or ADP is generated, the last signal BPS is released at the reversing position BP of this cycle to terminate the copying operation. The drum is however stopped by the drum home position signal DHP which is generated when a switch provided on the home position is actuated by a cam provided on said drum.

FIG. 4 is a circuit for selecting the copying magnification, wherein 39-1 is a switch for selecting "real-size" or "reduction" copying respectively by closing or opening the cover 39 to light the lamp 401 or to light the lamp 402 as well as to enable the selection of reduction modes; 403 is a group of switches for selecting either one of said reduction modes and respectively corresponding to those shown in FIG. 2-1; 404 and 405 are contacts to be connected to the lefthand terminal by the relay K1 when the power is supplied to the automatic document feeder set on the glass plate; 420 is a contact to be opened thereupon to select a size reduction mode from the A-4 size to the A-3 size regardless of the function of the switch group 403; 406-1 is a buffer amplifier for the reduction mode signal; 406-2 to 406-4 are latch circuits, such as flip-flops, for holding said signal during the copying operation; 407-411 are light-emitting diodes for displaying reduction copying modes; 422 is a differentiating circuit for forming a trigger signal for the circuit 407, and LATCH is a signal for rewriting the content of said latch circuit to be generated during the absence of copying operation.

The function of the above-explained circuit will be explained in the following. When the automatic document feeder is not set on the copier or lifted from the glass plate thereof, the switch for the size reduction from A-4 size to A-3 size is closed in the aforementioned manner, whereby a current is supplied through the diode 421 and contact 420 to light the diode 407 and to the latch circuit 401-2 to generate an output signal for setting the copier for said size reduction. On the other hand when the automatic document feeder is set on the copier, the contact 420 is opened and the contact 405 is changed over to turn on, even without the instruction for the size reduction from A-3 size to the A-4 size, the corresponding latch 406-3 thereby setting the copier for said size reduction mode. Simultaneously, as shown in FIG. 8, the signal SWS caused to forcedly select the reversing position BP1 and to actuate the upper feed roller 28-1 when the A-4 size sheet is contained in the upper cassette, regardless of the state of the cassette select switches 36 and 37. In this manner the originals of a particular size (for example A-3 size) can be repeated copied with a size reduction to another particular size (A-4 size) on the sheets of corresponding size. Thus the operation of the automatic document feeder and the copier can be extremely simplified as the image magnification can be uniquely fixed by simply setting the automatic document feeder.

Also the mistake of starting the copying operation without the original setting since neither the feeder nor the copier is functionable unless the power is supplied to both. Also the copier is versatile as it is further usable for ordinary copying without the use of automatic document feeder. Besides an original or a format not suitable for automatic feeding can be copied if it is inserted between the automatic document feeder and the copier, so that it is rendered possible to copy an automatically feedable original and an unfeedable original on a same transfer sheet by supplying such feedable original between the glass plate and the format original.

It will be also understood that the present invention is applicable not only to the automatic document feeder but also the manual document feeder as an attachment.

In case the present invention is applied to a color copier, it is rendered possible to select particular colors (for example black and red) when such attachment is set on the copier.

Now there will be explained the various sequence modes of the automatic document feeder and the copier. As explained in the foregoing, after an original is set on the glass plate, various control sequence modes can be selected according to the states of the automatic document feeder and the copier and the instructions thereto. Also in case of the jamming in the copier or the stop instruction, a better sequence control can be selected to enable rapid restart of copying operation after the jamming is eliminated or after the copy number is changed. Table 1 shows the various modes in case sheet originals are set for feeding by the automatic document feeder and in case the feeder is lifted for original setting and closed thereafter again.

TABLE 1

| | 1.Manual set | 1.Feed set | 2.Multi-copy | 3.Ejec-tion | 4.Next feed set | 5.Multi-copy | |
|---|---|---|---|---|---|---|---|
| a. | — | o | o | o | o | o | Normal operation by CPB |
| b. | — | o | o | o | o | x | STOP2 (3, 4) |
| c. | — | o | o | o | x | x | |
| d. | — | o | o | x | x | x | |
| e. | — | o | x | o | o | o | STOP, ADJ, MAN etc. |
| f. | — | o | x | o | o | x | |
| g. | — | o | x | o | x | x | |
| h. | — | o | x | x | x | x | |
| i. | — | o | interrupt | o | o | o | STOP2 (2) |
| j. | — | o | interrupt | o | o | x | |
| k. | — | o | interrupt | o | x | x | STOP, CJ, etc. |
| l. | — | o | interrupt | x | x | x | |
| m. | o | — | o | o | o | o | CPB after stop or jam |
| n. | o | — | o | o | o | x | STOP2 (3, 4) |
| o. | o | — | o | o | x | x | |
| p. | o | — | o | x | x | x | |
| q. | o | — | x | o | o | o | STOP, ADJ, MAN, etc. |
| r. | o | — | x | o | o | x | |
| s. | o | — | x | o | x | x | |
| t. | o | — | interrupt | o | o | o | |

TABLE 1-continued

| | 1.Manual set | 1.Feed set | 2.Multi-copy | 3.Ejec-tion | 4.Next feed set | 5.Multi-copy | |
|---|---|---|---|---|---|---|---|
| u. | o | — | interrupt | o | o | x | STOP2, CJ, etc. |
| v. | o | — | interrupt | o | x | x | |
| w. | o | — | interrupt | x | x | x | |

In the above Table 1, the modes a to 1 are for copying with the original feeding by the switches AUTO and CPB, wherein a is the ordinary ADF mode in which the copying is continued until the originals in the bucket are exhausted; b to d are modes for multiple copying of a single original wherein the mode b performing the setting of the next original but initiating the copying operation, corresponding to the actuation of the stop button STOP2 during the setting of the next original or prior to ejection of the preceding original whereby the copying being restarted by the button CPB, the mode c performing the original ejection after the completion of copying but not the setting of the next original, corresponding to the case of actuation of the stop button STOP1 of the automatic document feeder during original setting or multiple copying, or of the copying with the switches MAN and CPB, or of the jamming by original ejection error (ADJ3), wherein the copying can be restarted by the switches AUT and CPB after eventual elimination of jamming, and the mode d performing neither the ejection nor the feeding of the original wherein the setter portion can be opened as shown in FIG. 2 to see the state of the original and is reclosed to continue the copying with the automatic feeding, said continuation being represented by the modes m–w.

The mode e is for not making copies from the first fed original but for making copies from the next original, and the modes f, g and h respectively correspond, in such copying mode, to the cases of the modes b, c and d. The automatic document feeder may be provided with a key for such mode h whereby it is rendered possible to make multiple copies by the copy start button after the original setting on the glass plate is confirmed. Also the mode g can be achieved by a key exclusive for ejection, or otherwise by the stop button for the automatic document feeder. In this manner the modes e or f may be realized by the combination of the mode g with the mode a or c.

Also the modes e to h correspond to the case of jamming in the separation in the feeder (ADJ1) or in the original setting. In such case the automatic document feeder may be elected to completely stop (mode h), to perform ejection only (mode g), to perform ejection and next original setting (mode f) or to perform ejection and continue original feeding (mode e), but the ejection is preferably conducted manually in such case as the automatic ejection may cause damage to the original.

The modes i–l are the sequence modes determined by the states of the copier corresponding to the case of copy jamming (CJ) during multiple copying or of the actuation of the stop button STOP2 for empty cassette or other troubles wherein the copying operation is interrupted at the copy cycle under execution without completing the number of cycles set in advance. The mode i is for continuing the copying from the next original after interruption by the stop button and is effective in case the copying instruction for the original under execution is not cancelled. The modes j and k perform the original ejection and the next original setting only in case of interruption by the stop button or by the jamming. The mode 1 deactivates the automatic document feeder after the interruption whereby the remaining copying for the present original can be rapidly restarted after the jamming is eliminated or the paper replenishment, wherein the restarting modes being represented by the modes m–w. The modes m–v are effective for replacing the original on the glass plate after an original jamming or for inserting an urgent copying during the course of continuous copying with the automatic document feeder. The modes p and w correspond to ordinary copying modes with out the use of automatic document feeder.

Figures 2, 9:
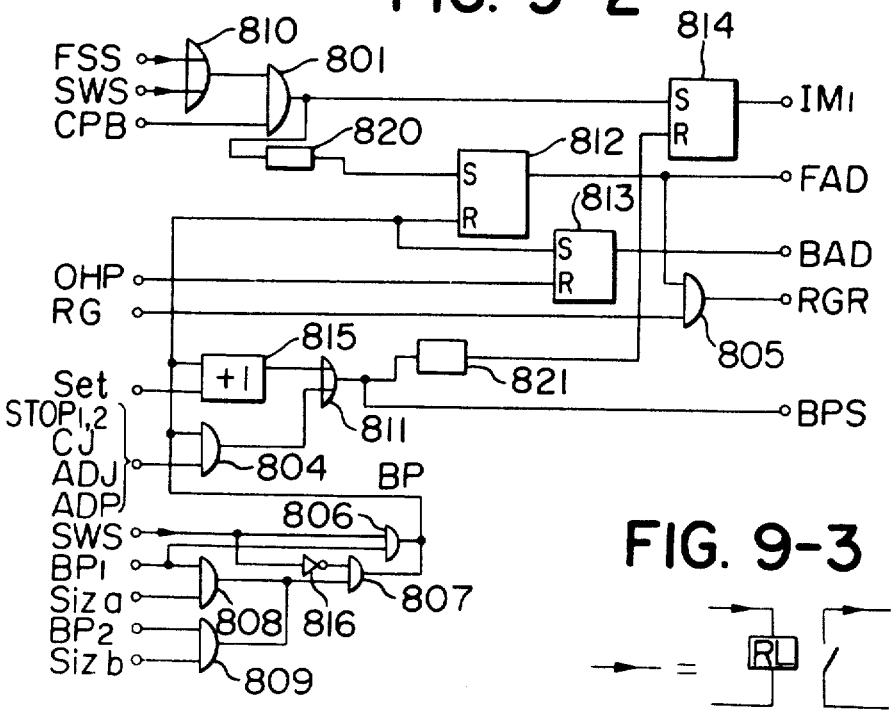
Figures 3, 9:
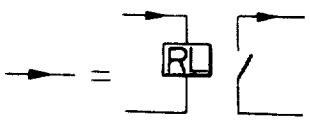
Figures 1, 9:
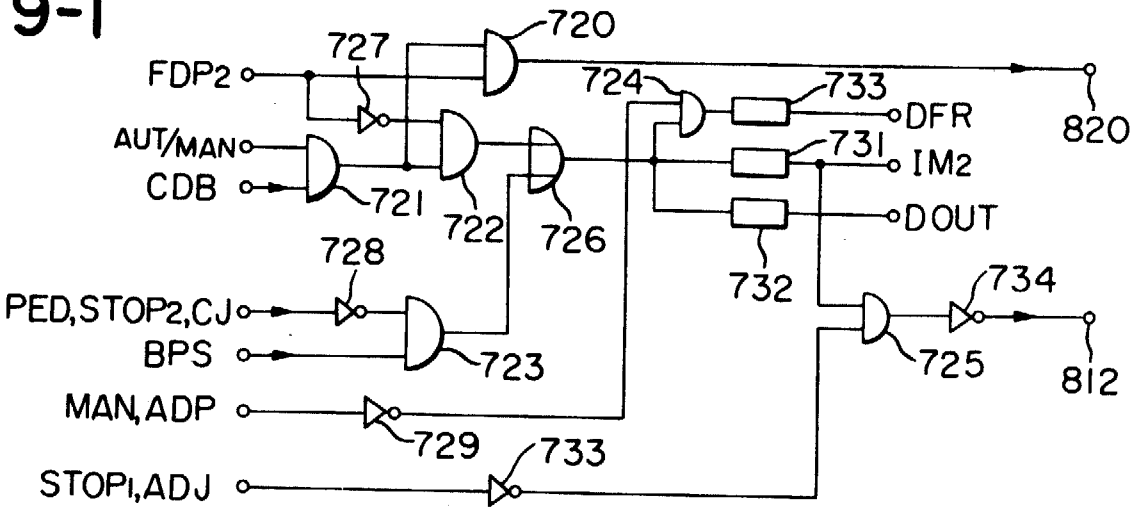
Figures 1, 10:
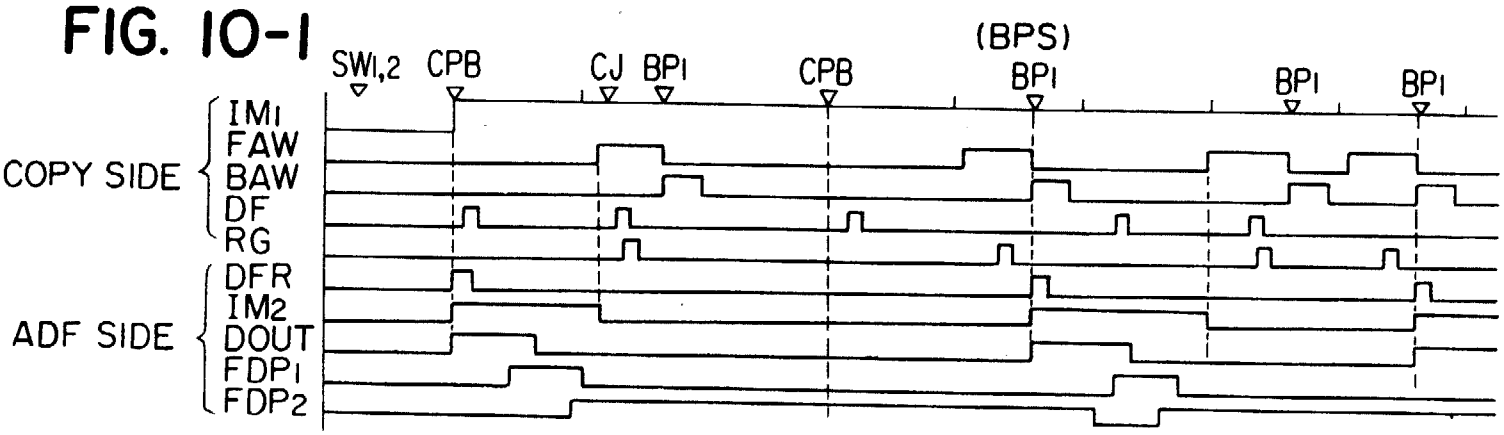
Figures 2, 10:
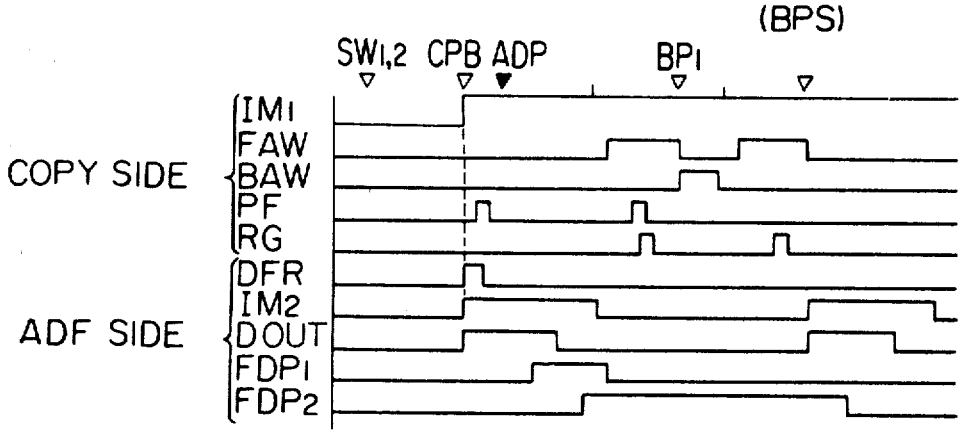
Figures 3, 10:
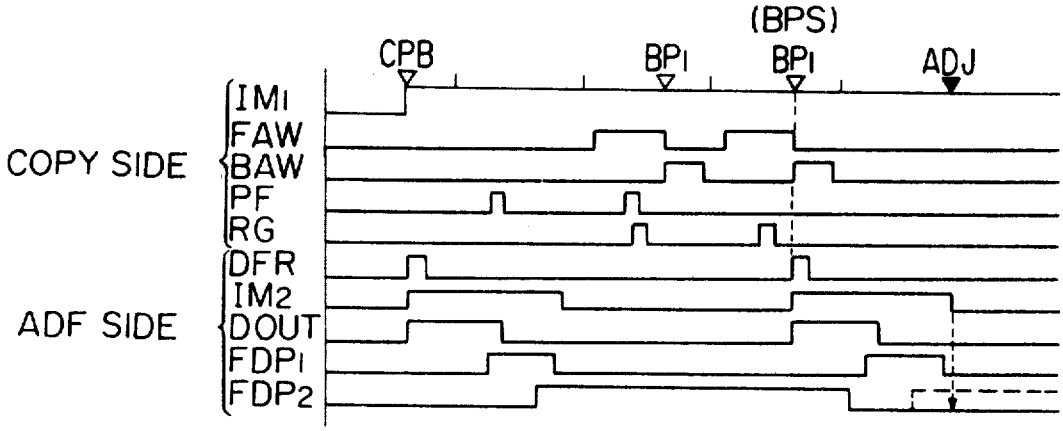

FIGS. 9-1 and 9-2 show another example of the control circuit for conducting various operating modes shown in Table 1, of which operating sequences are shown in FIGS. 10-1 to 10-3.

In FIG. 9-1 there are shown AND gates 720–725, an OR gate 726, inverters 727–729, and timers 730–732 of various lengths of time as shown in the time chart. In FIG. 9-2 there are shown timers 820 and 821 of the lengths of time as shown in the time chart, while other components are same as those shown in FIG. 8.

FIG. 9-3 shows a method of connecting the signals lines between the feeder and the copier by means of a relay provided on the signal-releasing side, such arrangement being effective in case the power supply voltage for control is different between the feeder and the copier.

FIG. 10-1 shows the time sequence in case of copier jamming (CJ), stop instruction STOP2 or empty cassette PEP, wherein the copier remains in the stand-by state without original ejection and maintaining the set and remaining copy number. After the elimination of jamming the exposure can be restarted by actuating the button AUT or MAN and the copy start button, whereby the timer 820 in FIG. 9-2 is activated through the gates 721, 720 to generate the signal FAW. Upon completion of the remaining copy cycles the function of the automatic document feeder is continued in the aforementioned manner, though the procedure ADP is conducted in case the manual button is actuated.

FIG. 10-2 shows the procedure in case of the absence of originals (ADP), wherein the ejection is conducted by the signal BPS but the feeding of next original is not conducted as the signal DFR is stopped by the gate 724.

FIG. 10-3 shows the case of the jamming in the automatic document feeder, wherein the succeeding scanning is prohibited by the gate 725 as the flip-flop 812 is set at the trailing end of the belt drive signal.

The above-explained examples are particularly useful in case of the use of a seamless photosensitive member on the drum in order to improve the copying speed.

FAN may be actuated simultaneously with the detector actuation or a predetermined time thereafter. In FIGS. 9-1 and 9-2, it is possible that, in case of the jam occurred, the number, equal to the number of copies jammed, of copies can additionally be copied in the copy operation resumed, and then the original is exchanged.

Figure 11:
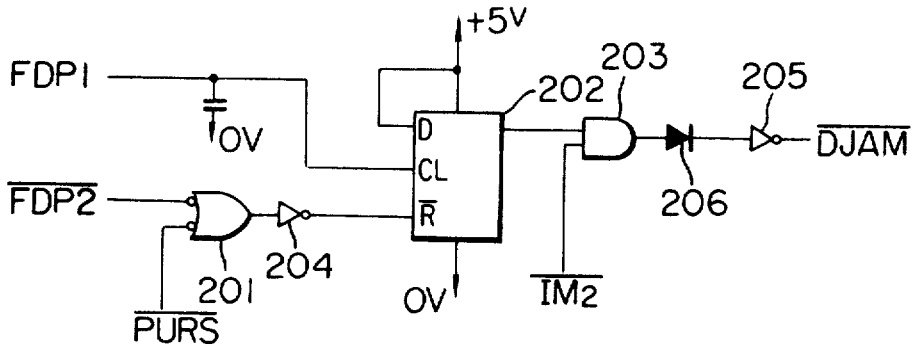
FIGS. 11 and 12 are circuit diagrams showing examples of jam detecting device.

FIG. 11 shows an example of the circuit for jam detection in the automatic document feeder, wherein FDP1 and FDP2 are original detection signals respectively released by the original detectors 44, 45 shown in FIG. 1-1 201 is an OR gate circuit for resetting a flip-flop 202 in response to said signal FDP2, said flip-flop 202 being set by said detection signal FDP1, IM2 is a motor drive signal for the belt 63, 203 is an AND gate for judging, by the timing signal $\overline{IMZ}$, the output Q of the flip-flop 202, DJAM is a signal indicating the presence of a jamming in the state "1" thereof, $\overline{PURS}$ is an initial reset signal for resetting the circuits when the power is supplied to the automatic document feeder by the closure of the power switch SW1, 204 and 205 are inverters for inverting the signals, and 206 is a diode for preventing the backward current.

In the operation of this circuit, the power switch SW1 is at first closed to release the signal PURS in "0" state, thereby shifting the gates 201 and 204 respectively to the states "1" and "0" and resetting the flip-flop 202 to obtain the output signal Q in "0" state.

Upon actuation of the copy start button 32 shown in FIG. 2, the rollers 60, 61 and 62 are started and the signal IM2 is released to drive the belt motor for a determined period. Upon arrival of an original advanced by said rollers at the detector 44, the signal FDP is changed to the state "1", whereby the output signal Q of the flip-flop 202 changes to "1" shift the gate 203 to the state "1". $\overline{DJAM}$ is "1" in this state as $\overline{IM2}$ is zero. In case the original is correctly fed, the original reaches the detector 45 before the belt motor is stopped, thereby obtaining the "1" signal $\overline{FDP2}$ to shift the gate 201 and 204 respectively to the states "1" and "0" thereby resetting the flip-flop 202. Thus the gate 203 releases an output "0", thus giving the "0" DJAM signal indicating the absence of jamming. On the other hand when the original is stopped on the way, the signal FOP2 remains at the state "1", thus not causing the resetting of the flip-flop 202. Thus, as the input signal to the gate 203 remains at the level "1", the output thereof when the belt is stopped ($\overline{IM2}=1$) becomes "1", thus giving a jag signal DJAM. Said signal holds the relay which inhibits the supply of copy sheet thus prohibiting the start of copying cycle and causes the corresponding display, said holding state of the relay being maintained until manually released. The driving time of the belt motor is selected in such a manner that said motor is stopped shortly after the original reaches the claw 46, thus the belt 63 merely gliding over the original after it is stopped by said claw 46.

Since the jamming is identified in the present invention by the signal for controlling the belt drive, it is rendered possible to rapidly detect the original jamming on the glass plate 14, and to achieve an improved detection accuracy with a simplified circuit even without timer etc. which have been utilized for jam detection.

Also it is possible to rapidly detect the original jamming at the insertion of original into the belt 63, by placing the detector 45 at an intermediate position in the non-image area of the setter portion and by utilizing the drive off signal of the rollers 61, 62 as the jam check signal instead of the $MI_2$ off signal.

Figure 12:
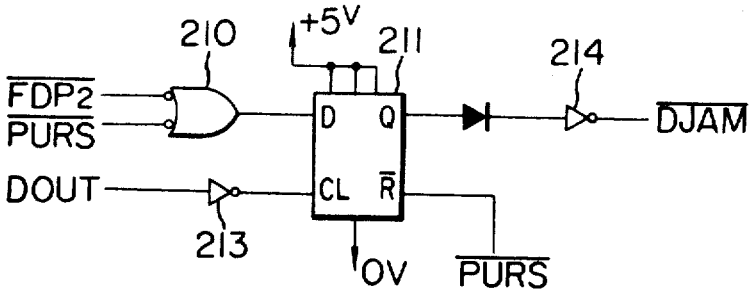
Figure 13:
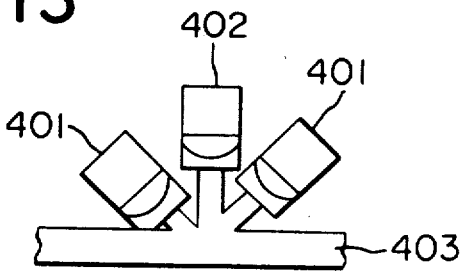
FIG. 13 is a cross-sectional view showing an example of the original detecting device.

FIG. 12 shows an example of the circuit for detecting eventually remaining original at the ejection of the original after completion of the copying cycle, wherein DOUT is the signal for lowering the claw 46, and 211 and 212 are flip-flops. In this circuit the flip-flop 211 is reset at the closure of the power switch, and a signal "1" is supplied to the port D of said flip-flop when the fed original reaches the detector 45. When the optical system (for example mirror) reaches the reversing position upon completion of copying cycles of the preset number, the signal DOUT is released to elevate the claw 46 and to drive the belt 63 thereby ejecting the original, wherein said signal DOUT being maintained for a period T2 required for the ejection of the original in the normal operation. Upon completion of the ejection the signal $\overline{FDP2}$ assumes the level "1" to change the signal to the port D of said flip-flop to "0", whereby the flip-flop 211 is not changed at the leading end of the signal DOUT for lowering the claw. However, in case the original remains in the apparatus by some reason, the flip-flop 211 releases the signal "1" from the port Q thereof at the leading end of the signal DOUT to change the signal $\overline{DJAM}$ to "0" thereby indicating the jamming or remaining original. The succeeding functions are similar to those explained in connection with FIG. 11. Also it is possible, in case of FIG. 12, to give a display different from that for the jamming explained in FIG. 11. Furthermore it is possible, simultaneously with the generation of the above-mentioned signal DOUT, to identify if the detector 44 detects the original, and, if not, to take the aforementioned procedure for the feed jam DJAM.

The present invention is applicable not only to the jamming in the automatic original feeding device, but also to the jamming in the transportation of the transfer material in the copier. In such case the jam detection can be achieved by positioning the transfer sheet detector immediately before the transfer station or the rollers 29-1, 29-2 and utilizing the function off signal for the rollers 28-1, 29-1 etc. as the jam check signal.

Figure 14:
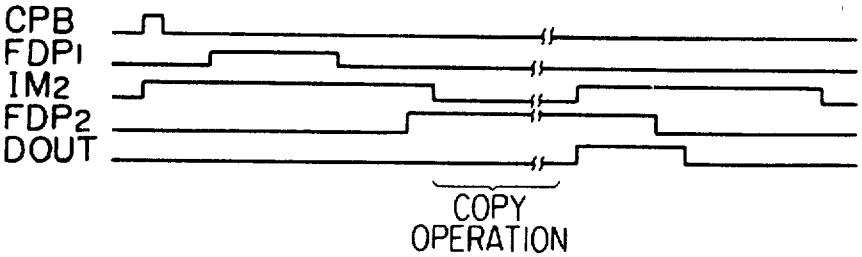
FIG. 14 is a function time chart of the circuits shown in FIGS. 11 and 12.

FIG. 14 is a time chart of various signals in the normal transportation.

As will be apparent from FIG. 6, the detector 45 is utilized when the exposure lamp 16 is turned off, so that there is no danger of erroneous function even when the reflective detector is located close to the glass plate for supporting the original.

Figure 15:
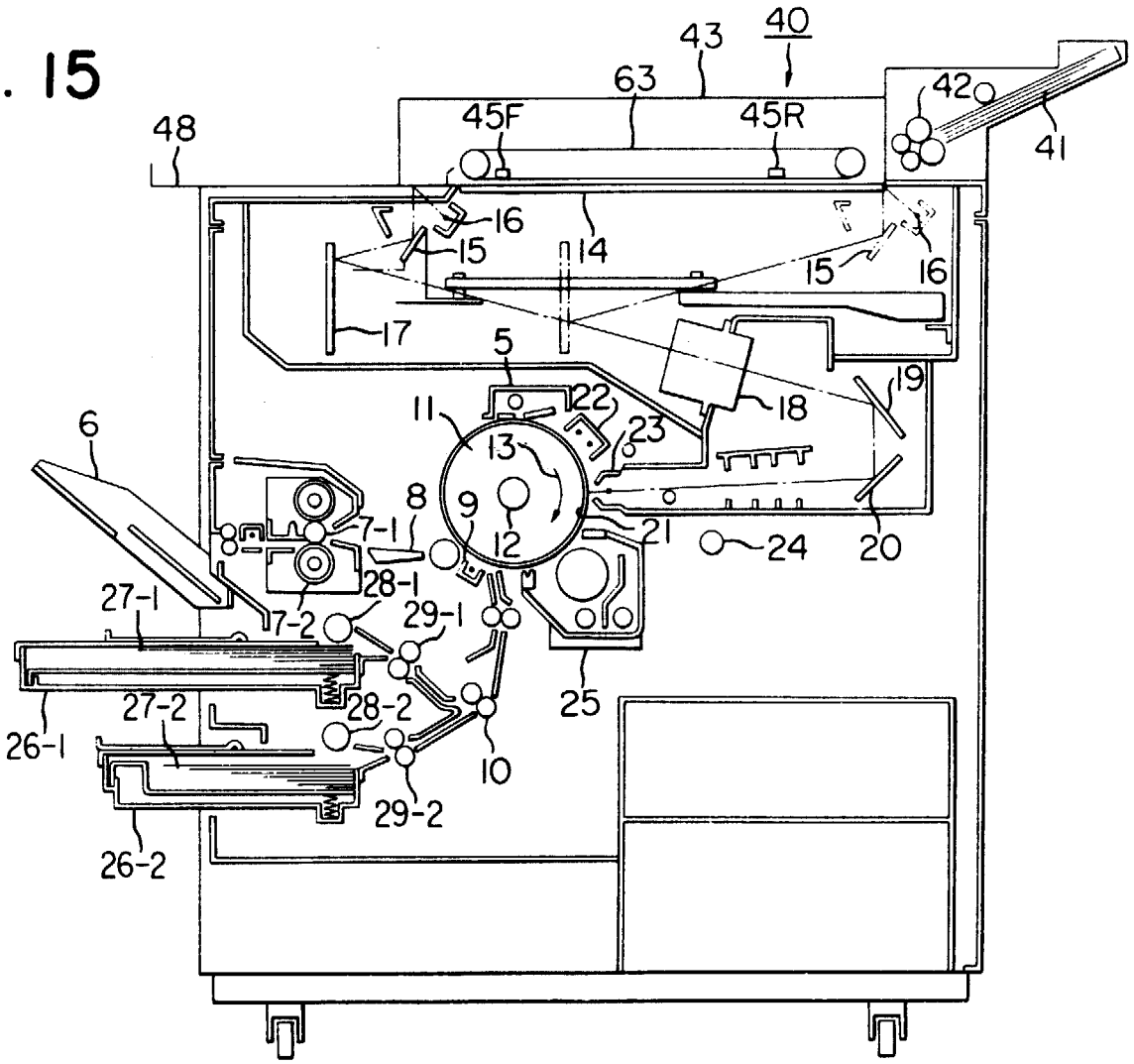
FIG. 15 is a cross-sectional view of a copier wherein the present invention is applicable.

FIG. 15 shows an example of the copier provided with reflective original detectors 45F and 45R respectively utilized for detecting the front end and rear end of the original, while other portions of the copier being identical to those shown in FIG. 1-1. Said detector 45F detects whether the front end of the original 147 supplied from the feeder 42 reaches a determined position in the space 144 within a determined time, and the detector 45R detects the rear end of said original. The eventual absence of the detection either by the detector 45F or by the detector 45R indicates the non-arrival of the original, i.e. the presence of jamming in said space 144.

Figure 16:
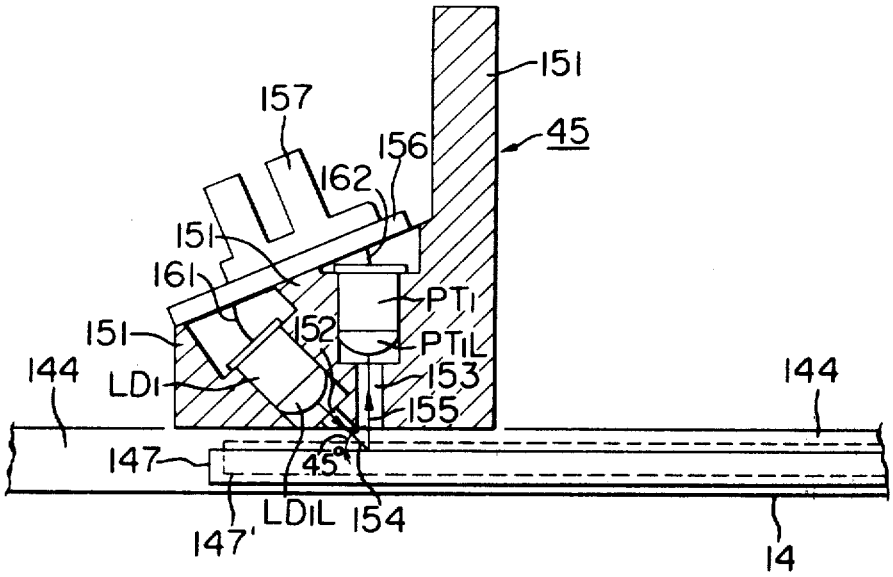
FIG. 16 is a cross-sectional view of a conventional reflective detecting device.

FIG. 16 shows a conventional reflective detecting device wherein there are shown a phototransistor PT1 functioning as the photoreceptor, a lens system PT1L for said phototransistor PT1, a light-emitting diode LD1 functioning as the light emittor, a lens system LD1L therefor, a support 151 with a black surface, an illuminating aperture 152 provided in said support to guide the light emitted by said light-emitting diode LD1, a diffuse light guiding aperture 153 for guiding the diffuse reflected light from an original 147 to said phototransistor PT1, an incident optical axis 154, a diffuse reflected optical axis 155, a printed circuit board 156 having lead wires 161, 162 and a connector 157. When the original is supplied into said space 144, the incident beam from the light-emitting diode LD1 along the optical axis 154 is diffuse reflected by the surface of said original 147, and the diffuse reflected light along the optical axis 155 is received by said phototransistor PT1 to identify the presence of said original 147.

Figure 17:
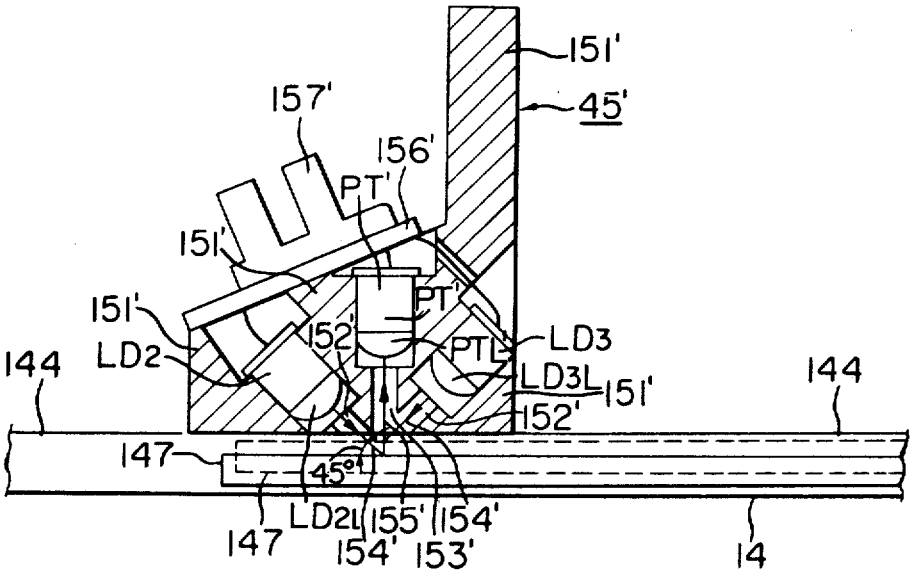
FIG. 17 is a cross-sectional view of a reflective detecting device embodying the present invention.

In such conventional device, however, in case the original 147 is located in the upper portion of said space 144 as represented by the broken line 147', the optical axis of the reflected light is displaced to the left as the position of reflection is displaced upward, whereby the reflected light becomes scarcely received by the phototransistor PT1. Such drawback can be prevented in an embodiment shown in FIG. 17, wherein the component of the same function as that in FIG. 16 is represented by the same primed number. In this embodiment, in place of the light-emitting diode LD1 there are provided two light-emitting diode LD2 and LD3 mounted on a support 51' with a same angle but at different heights, whereby the diffuse reflected light can be securely received by the phototransistor PT' with a high reliability, regardless whether the original 147 is located low as represented by the full line or high as represented by the broken line.

In the transport path for the original or the copy sheet it is generally not possible to determine the exact position of the paper as it is transported in a somewhat waving state. The above-mentioned embodiment is particularly useful in such case in assuring secure detecting operation.

Although there are provided two light emittors in the foregoing embodiment, it is naturally possible to use three or more light emittors in order to secure a wider range of detection.

Also the foregoing embodiment is explained in connection with the original detection in the copier, it is naturally applicable also for the jam detection for the copy sheet, or for any other detecting purposes.

Figure 18:
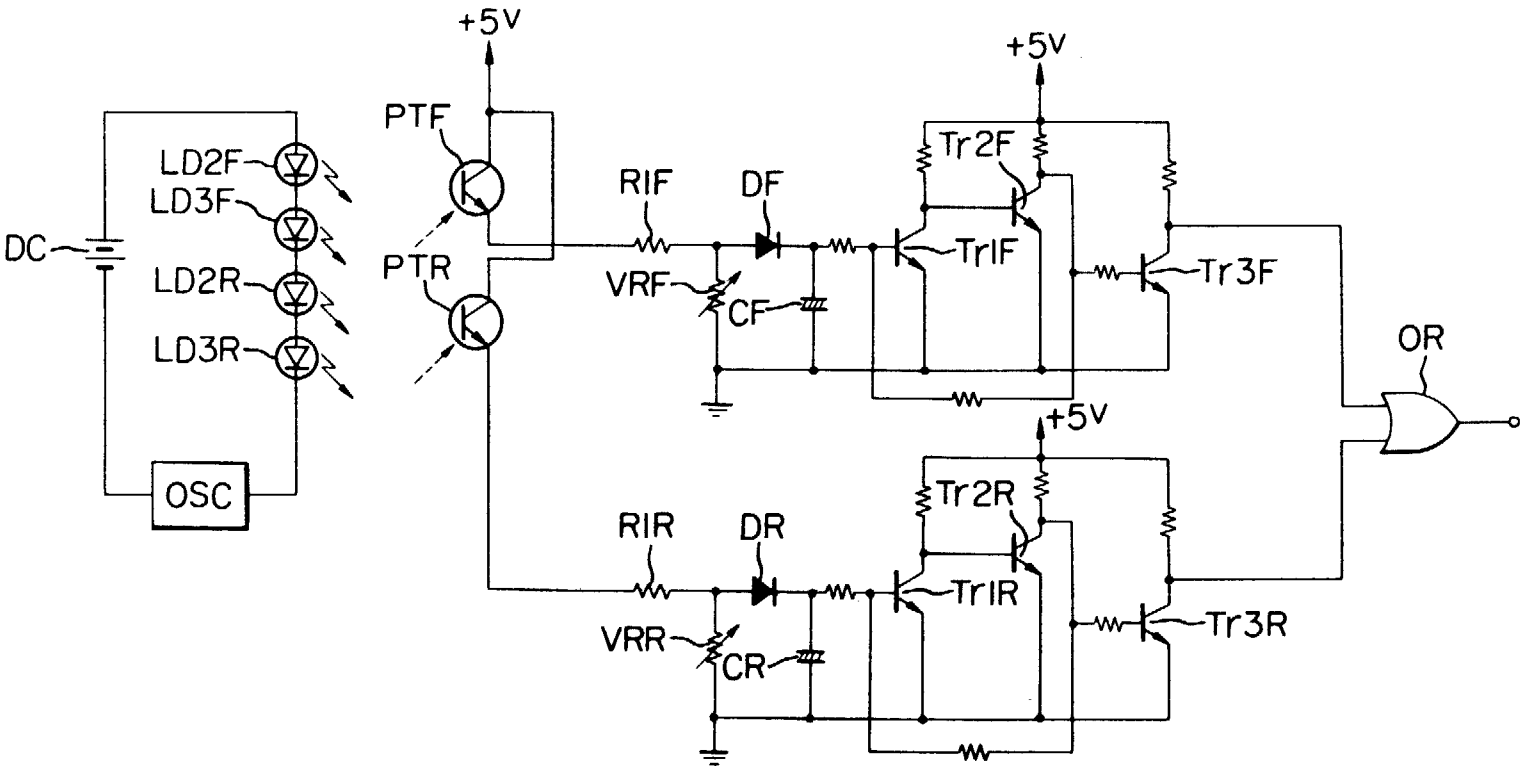
FIG. 18 is a view of the control circuit.

In FIG. 18 there will be shown a circuit for driving the above-explained detecting device, wherein the suffixes F and R respectively relate to the front end and rear end detection. Light-emitting diodes LD2F, LD3F, LD2R and LD3R are serially connected to a direct-current power source DC through an oscillating circuit OSC having an oscillating frequency of approximately 1 kHz to cause the light-emitting diodes to oscillate at the same frequency. In order to increase the light emission the light-emitting diodes require an increased current which however may result in a shorter service life of the diodes, but the above-mentioned oscillation serves to prevent this danger.

Upon receipt of the reflected light the photodiode PT generates a similarly oscillating output which is rectified by a diode D and smoothed by a condenser D to turn on transistors Tr1 and Tr3 and to turn off a transistor Tr2.

Thus, upon receipt of the reflected by both of phototransistors PTF and PTR, an OR gate receives input signals of both low level to release a low-level output. On the other hand, in case the reflected light is not received by either one or both of said phototransistors the OR gate releases a high-level output, indicating the presence of jamming. In this manner a jam signal is obtained in case the original is not correctly aligned on the glass plate, and a safety function is performed by the AND condition of the aforementioned jam check timing signal and the output of said OR gate. In case the setting belt 43 is maintained in continuous circulating motion as in the present embodiment, the original may eventually be folded up by said belt, but the above-explained device is capable of detecting such state and taking suitable safety action. Furthermore it is possible to provide plural rear end detectors along the advancing direction of the original and selectively utilize such detectors according to the size of the original.

Also it will be noted that the distance between said front end detector 45F and the rear end detector 45R is selected slightly smaller than the longitudinal length of the original.

What we claim is:

1. An image forming apparatus, comprising:
means for forming a copy image of an original document on a copy material, said means including movable means for scanning the original document;
means for feeding the original document to a predetermined position for copying;
means for starting said scanning means;
means for feeding the copy material for copying, wherein said copy material feeding means starts its operation after the start of said original document feeding means, but before operation of said starting means;
means for detecting jamming of the original document; and
means for controlling said means for forming a copy image in response to an output from said detecting means.

2. An apparatus according to claim 1, wherein said control means is effective to prevent said scanning means from starting in response to said output.

3. An apparatus according to claim 1, wherein said detecting means is associated with the timing of the operation of said original document feeding means.

4. An apparatus according to claim 1, wherein said detecting means detects jamming after operation of said material feeding means but before operation of said scanning means.

* * * * *